US012722818B2

(12) United States Patent
Biondi et al.

(10) Patent No.: US 12,722,818 B2
(45) Date of Patent: Sep. 1, 2026

(54) UNIT AND METHOD FOR PACKAGING ARTICLES IN BOXES

(71) Applicant: R.A JONES & CO., Covington, KY (US)

(72) Inventors: Andrea Biondi, Bologna (IT); Luca Cavazza, Bologna (IT); Ivanoe Bertuzzi, Bologna (IT); Enrico Campagnoli, Bologna (IT); Marco Ghini, Bologna (IT); Luca Borderi, Bologna (IT)

(73) Assignee: R.A JONES & CO., Covington, KY (US)

( * ) Notice: Subject to any disclaimer, the term of this patent is extended or adjusted under 35 U.S.C. 154(b) by 136 days.

(21) Appl. No.: 18/724,169

(22) PCT Filed: Dec. 20, 2022

(86) PCT No.: PCT/IB2022/062506
§ 371 (c)(1),
(2) Date: Jun. 25, 2024

(87) PCT Pub. No.: WO2023/126765
PCT Pub. Date: Jul. 6, 2023

(65) Prior Publication Data

US 2025/0066051 A1 Feb. 27, 2025

(30) Foreign Application Priority Data

Dec. 29, 2021 (IT) ..... 102021000032915

(51) Int. Cl.
*B65B 5/02* (2006.01)
*B65B 35/10* (2006.01)
(Continued)

(52) U.S. Cl.
CPC ..... *B65B 5/024* (2013.01); *B65B 35/10* (2013.01); *B65B 43/12* (2013.01); *B65B 43/265* (2013.01); *B65B 43/285* (2013.01)

(58) Field of Classification Search
CPC ..... B65B 5/024; B65B 35/10; B65B 43/12; B65B 43/265; B65B 43/285
See application file for complete search history.

(56) References Cited

U.S. PATENT DOCUMENTS 1,875,986 A * 9/1932 Bronander ..... B65B 19/24 53/575
3,435,735 A * 4/1969 Whitaker ..... B65B 19/24 493/205

(Continued)

OTHER PUBLICATIONS

International Preliminary Report on Patentability issued for International PCT Application No. PCT/IB2022/062506 filed on Dec. 20, 2022 on behalf of R.A Jones & CO. Mail Date: Jun. 20, 2024. 7 pages.

(Continued)

*Primary Examiner* — Anna K Kinsaul
(74) *Attorney, Agent, or Firm* — Steinfl + Bruno LLP

(57) ABSTRACT

A packaging unit of articles in boxes includes a mandrel, a movement device, a feeding device, a folding device, and a first retaining device. The mandrel is configured to accommodate at least one of the articles therein. The movement device is configured to move the mandrel along a movement trajectory. The feeding device is configured to feed at least one blank towards the mandrel. The folding device is configured to cooperate with the mandrel to fold at least one panel of the blank being wound around the mandrel, and to form one of the boxes. The first retaining device is movably guided parallel to the movement trajectory and is configured to cooperate with the mandrel, along a section of the movement trajectory, retaining the at least one panel of the (Continued)

blank, wound on the mandrel, against an abutment surface of the mandrel extended parallel to the movement trajectory. A packaging method of articles into boxes by means of such a unit is also described.

16 Claims, 6 Drawing Sheets

(51) Int. Cl.

| | |
|---|---|
| ***B65B 43/12*** | (2006.01) |
| ***B65B 43/26*** | (2006.01) |
| ***B65B 43/28*** | (2006.01) |

(56) References Cited

U.S. PATENT DOCUMENTS

| | | | | | |
|---|---|---|---|---|---|
| 3,875,724 | A * | 4/1975 | Langen | B65B 11/004 | 53/462 |
| 3,935,694 | A * | 2/1976 | Langen | B65B 49/02 | 493/131 |
| 3,978,639 | A * | 9/1976 | Ferrozzi | B65B 11/58 | 53/449 |
| 4,292,102 | A * | 9/1981 | Bidegain | B31B 50/024 | 156/487 |
| 4,838,846 | A * | 6/1989 | Focke | B65B 51/026 | 493/278 |
| 5,115,625 | A * | 5/1992 | Barbulesco | B65B 7/20 | 53/284 |
| 5,120,292 | A * | 6/1992 | Ueda | B31B 50/322 | 493/134 |
| 5,771,666 | A * | 6/1998 | Bertuzzi | B65B 19/225 | 493/166 |
| 5,802,819 | A * | 9/1998 | Boldrini | B65B 11/32 | 53/482 |
| 5,806,289 | A * | 9/1998 | Sassi | B65B 19/24 | 53/575 |
| 5,946,890 | A * | 9/1999 | Focke | B65D 85/10 | 53/236 |
| 6,047,529 | A * | 4/2000 | Draghetti | B65B 51/02 | 53/466 |
| 6,170,239 | B1 * | 1/2001 | Focke | B65B 51/023 | 53/406 |
| 6,341,474 | B1 * | 1/2002 | Focke | B65B 19/245 | 53/463 |
| 6,599,225 | B2 * | 7/2003 | Ammons | B31B 50/84 | 493/190 |
| 6,708,466 | B2 * | 3/2004 | Spatafora | B65B 19/225 | 53/449 |
| 7,559,186 | B2 * | 7/2009 | Smith | B65B 49/12 | 53/232 |
| 11,136,153 | B2 * | 10/2021 | Langen | B65B 61/26 | |
| 11,584,551 | B2 * | 2/2023 | Kenn | B65B 3/027 | |
| 2009/0170678 | A1 * | 7/2009 | Smith | B31B 50/44 | 493/51 |
| 2019/0389611 | A1 * | 12/2019 | Pettersson | B31B 50/006 | |
| 2020/0254707 | A1 * | 8/2020 | Iwasa | B65B 5/024 | |
| 2020/0282684 | A1 * | 9/2020 | Ghiotti | B65B 5/06 | |
| 2025/0066051 | A1 * | 2/2025 | Biondi | B65B 49/08 | |

OTHER PUBLICATIONS

International Search Report and Written Opinion issued for International PCT Application No. PCT/IB2022/062506 filed on Dec. 20, 2022 on behalf of R.A Jones & CO. Mail Date: Jun. 28, 2023. 9 pages.

* cited by examiner

UNIT AND METHOD FOR PACKAGING ARTICLES IN BOXES

CROSS REFERENCE TO RELATED APPLICATIONS

The present application is the U.S. national stage of International Application No. PCT/IB2022/062506 filed on Dec. 20, 2022, which, in turn, claims priority to Italian Patent Application No. 102021000032915 filed on Dec. 29, 2021.

The present invention relates to a unit and a method for packaging articles in boxes.

The contents of Italian Patent Application No. 102021000032933, filed on 29 Dec. 2021 by the same Applicant, entitled "Device for packaging articles in boxes and relative packaging method" is deemed to be incorporated herein in its entirety.

The present invention finds a preferred, though not exclusive, application in the field of packaging articles of variable geometry and which are relatively delicate in boxes, such as bags of cereal, a field to which reference will be made later without losing generality.

In particular, in the relevant technical field, packaging units are known in which the packaging of the article inside a box is obtained from a blank which is wound around the article.

This well-known packaging mode, also known as the 'wrap-around' mode, involves the box being formed by winding the blank, e.g., a shaped cardboard, around a mandrel containing the article to be packaged. Such a mode provides that the blank is wound around the mandrel so as to form a box closed laterally but open at at least one end thereof, from which the mandrel is then extracted, leaving the article inside the newly formed box. The open end can then be closed again, so that the resulting package can be sent to the final packaging stages.

In the present description as well as in the accompanying claims, certain terms and expressions are deemed to have the meaning expressed in the following definitions, unless expressly stated otherwise.

The term 'article' means any product which can be packaged in boxes. The articles can have a predefined geometric shape or they can have a variable geometry.

Non-exclusive examples of such articles are known from the food and confectionery sector and can refer to loose articles or those contained inside bags, pouches or other types of wrapping.

Preferably, the articles are food and confectionery articles, either loose or contained inside bags or other types of wrapping, such as bags of cereals or capsules of coffee or other infusion drinks, individual chocolates (wrapped or unwrapped), candies, pouches containing solid, liquid or semi-solid food products; in addition, articles from the ceramic industry, absorbent articles for sanitary use, articles from the tobacco industry, articles from the cosmetics industry, articles from the pharmaceutical industry, articles from the personal & home care industry.

'Packaging' of one or more articles in a box means obtaining a box containing said one or more articles. Such packaging can be obtained by forming a box around the article to be contained.

'Mandrel' means a support capable, on the one hand, of receiving and supporting the article to be packaged and, on the other hand, of providing an effective abutment for folding the blank when wound around the same.

'Blank' means a shaped sheet of suitable material and thickness adapted to be wound by means of folding around a mandrel to form a box. Panels are identified in the blank, delimited by preferred folding lines, which form the walls of the formed box. Preferably, the blank is made of cardboard or cardstock.

'Box' means any container adapted to contain one or more articles for the purpose of packaging them, which can be made from a blank by folding around a mandrel and subsequent fixing at its edges or panels.

A box is 'partially closed' when it has at least one closed contour section, most preferably when it is closed laterally around the mandrel while the longitudinal ends are kept open.

The 'folding line' of a blank is defined as a predefined line around which two portions or panels of the blank are expected to rotate relative to each other so as to fold the blank, preferably around the mandrel.

The folding line can be a virtual line even if it is predefined.

The folding line is preferably defined by a weakening line obtained on the blank, e.g., a creasing, or an incision or a plurality of aligned holes.

Mandrel 'movement device' means any device capable of displacing the mandrel or a plurality of mandrels along a straight or curved movement trajectory, in which the winding step leading to the formation of the box occurs. Examples of movement devices are represented by robotic arm systems, systems with electric, pneumatic or hydraulic actuators, or systems configured as 'carousels' to carry the mandrels along essentially circular trajectories.

Blank 'feeding device' means a device which picks up the blanks one by one and inserts them in the mandrel movement trajectory to be wound around the mandrel, for box formation. Examples of feeding devices are represented by members provided with gripping systems, e.g., with grippers or suction cups, configured to pick up the individual blanks from a warehouse, e.g., a blank stacking area, and displace them towards the mandrel in an appropriate relative orientation.

The term 'folding device' refers to a device which, inserted in the mandrel movement trajectory, is intended to impact the panels of the blank to fold them in winding around the mandrel.

'Retaining device' means a device which, during the movement of the mandrel along its trajectory, retains the panels of the blank wound on the mandrel, against abutment surfaces of the mandrel, so that the closure of the box is achieved, by superimposing corresponding portions or flaps of panels of the blank and their mutual fixing, e.g., by gluing.

The term 'horizontal' means an orientation extended substantially perpendicular to the vertical direction of gravity.

In 'wrap-around' packaging processes, the article to be packaged is fed along a conveyor line to be transferred and received inside a mandrel. Said mandrel is moved along a movement trajectory of a forming path in which the winding step of the blank around the mandrel occurs with the formation and closing of the box, e.g., by gluing overlapping flaps thereof.

In the first box formation step, it is envisaged that the blanks are inserted one at a time in the forming path. This insertion operation is carried out so that a respective mandrel intercepts a corresponding blank along the movement trajectory in a position intersecting the trajectory. In a subsequent operating step, a folding device arranged along the trajectory is expected to cooperate with the mandrel so as to fold at least one panel of the blank being wound around the mandrel. Preferably, a pair of panels of the blank, forming opposed walls of the box, are folded in winding around the mandrel and retained against the same, e.g., sliding the mandrel along the trajectory, between a pair of opposed abutments, e.g., between a pair of plates spaced from each other so as to allow the mandrel to slide and the retaining action of the blank panels against the mandrel.

The Applicant has been able to observe that one of the critical steps in packaging articles inside a box by means of a wrap-around type packaging process is the closing of the blank once it is wound around the mandrel. Such closure involves a number of distinct operations, such as folding the rear panels (with respect to the advancement direction of the mandrel) along a corresponding folding line and their fixing, typically by gluing, onto each other.

In particular, the Applicant has further observed that the folding of the rear panels is generally obtained thanks to the action of a closing member which is lowered from above so as to impact the rear panels and fold them against the mandrel, once the mandrel has exited the pair of plates of the folding device.

The Applicant has found, however, that when operating in the manner described above, often the folding of the rear panels does not occur accurately along the folding edges of the mandrel and, furthermore, the rear panels are not always glued together in the correct relative overlapping condition.

In fact, the Applicant has observed that in the absence of abutment of the panels, the latter can in fact suffer a swelling effect, which causes them to detach from the abutment surface, such an effect being caused by both the elastic return of the panels folded against the mandrel by the folding device and by the same folding action exerted on the rear panels, with the risk that the folded rear panels do not accurately overlap each other.

The Applicant thus understood that in order to ensure the precise folding of the rear panels along the folding edges of the mandrel and their correct gluing in the relative overlapping condition, the mandrel should be driven ensuring that the blank panels folded thereon are always held abutting against the respective abutment surfaces of the mandrel.

The Applicant thus perceived that, in the section of the trajectory affected by the folding of the rear panels on the mandrel, the retention of the panels against the mandrel could occur while accompanying the mandrel along its trajectory after having abutted it exiting from the folding device, so as to free the space suitable for the operational movement of the closing member relative to the mandrel.

The Applicant has finally found that a movable retaining device guided along the trajectory in cooperation with the mandrel to retain the panels of the blank wound on the mandrel, against an abutment surface of the mandrel, could ensure, when folding the rear panels, their precise positioning, in the correct relative overlapping condition, for closing the box.

Therefore, in a first aspect thereof, the present invention relates to a unit for packing articles in boxes, comprising a mandrel.

Preferably such a mandrel is configured to accommodate at least one of said articles therein.

Preferably such a packaging unit comprises a movement device configured to move said mandrel along a movement trajectory.

Preferably, such a packaging unit comprises a feeding device configured to feed at least one blank towards said mandrel.

Preferably, said packaging unit comprises a folding device configured to cooperate with said mandrel so as fold at least one panel of said blank being wound around said mandrel, so as to form one of said boxes.

Preferably, such a packaging unit comprises a first retaining device movably guided parallel to said movement trajectory.

Preferably, the first retaining device is configured to cooperate with the mandrel, along a section of said movement trajectory.

Preferably, the first retaining device retains said at least one panel of the blank, wound on the mandrel, against an abutment surface of the mandrel.

Preferably, the abutment surface of the mandrel is extended parallel to the movement trajectory.

In a second aspect, the present invention relates to a method for packaging articles in boxes.

Preferably, said method comprises the step of providing a mandrel and accommodating at least one of said articles in said mandrel.

Preferably said method comprises the step of moving said mandrel along a movement trajectory.

Preferably, said method comprises the step of feeding at least one blank towards the mandrel.

Preferably said method comprises the step of providing a folding device configured to cooperate with said mandrel.

Preferably, the folding device is configured to fold at least one panel of said blank being wound around the mandrel, for the formation of one of said boxes.

Preferably said method comprises the step of moving a first retaining device along a section of the movement trajectory to cooperate with the mandrel.

Preferably during the movement step, the first retaining device is moved parallel to the movement trajectory.

Preferably said method comprises the step of retaining said at least one panel of the blank, wound on the mandrel, against an abutment surface of the mandrel, by means of said first retaining device.

Preferably said abutment surface is extended parallel to the movement trajectory.

Thanks to these features, the folding of the rear panels occurs accurately along the folding edges of the mandrel, ensuring that the rear panels and the flaps thereof destined to be fixed by gluing are glued together in the correct relative overlapping condition.

In at least one of the aforesaid aspects, the present invention can further have at least one of the preferred features described below.

In a preferred embodiment, said packaging unit comprises a second retaining device, arranged downstream of said first retaining device, which is configured to retain said at least one panel of the blank against said abutment surface of the mandrel, in the advancement movement of the mandrel downstream of said section of movement trajectory.

Preferably the second retaining device is spaced apart from the folding device along said trajectory.

Preferably, the first retaining device is movable between the folding device and the second retaining device.

In a preferred embodiment, the first retaining device is mounted on the second retaining device.

In a preferred embodiment, the second retaining device comprises a pair of mutually spaced and parallel plate-like elements. Preferably, the plate-like elements are constrained to a fixed structure of said unit.

This significantly simplifies the movement of the mandrel once the box wound thereon has been partially closed.

In a preferred embodiment, the packaging unit comprises an actuation device configured to displace said first retaining device along said section of movement trajectory. Preferably, said actuation device is configured to displace said first retaining device in a first stroke of said movement trajectory, towards the folding device, with approach to the mandrel, more preferably, said first stroke is continued in a second return stroke, in the opposite direction.

Preferably along at least part of the second stroke, the first retaining device is carried to accompany the mandrel with the same advancement speed as the mandrel.

This ensures that the panels wound on the mandrel are always held abutted against the mandrel during the advancement of the mandrel in the folding step of the rear panels.

Preferably the first stroke is extended along at least part of the extension of the movement trajectory between the folding device and the second retaining device.

Preferably, the first and the second stroke have equal extension along said section of movement trajectory.

Preferably said section of movement trajectory has a curvilinear profile, more preferably shaped like an arc of a circumference.

In a preferred embodiment, the actuation device is configured to displace the first retaining device along the first stroke between a first position, in which the first retaining device is spaced apart from the advancing mandrel, and a second position, in which said first retaining device is positioned in proximity to a first folding edge of the mandrel facing the folding device.

Thanks to this feature, the panels held against the mandrel are prevented from undergoing, even only partially, undesirable swelling effects, which would cause them to detach from the abutment surface, such an effect being caused by both the elastic return of the panels folded against the mandrel by the folding device and by the same folding action exerted on the rear panels.

Preferably, said first retaining device, in said first position, is approached to the second retaining device.

Preferably, said first retaining device, in said second position, is displaced to a remote position from said second retaining device.

In a preferred embodiment, said first retaining device comprises an arm operatively associated with the actuation device.

Preferably, said arm bears at one end thereof a head capable of retaining, in resting contact, at least one panel of the blank against the corresponding abutment surface of the mandrel.

Preferably said head is configured to extend, in contact with the blank, along a prevalent part of the dimension of that at least one blank panel developed along the first folding edge.

An extended retaining action is thereby obtained along the entire longitudinal extension of the panel.

In an embodiment, the first retaining device comprises a plate-like element configured to cooperate with said head in retaining at least one panel of the blank against the corresponding abutment surface of the mandrel.

Thereby, the retaining action of the panel against the blank affects a larger surface portion of the panel, which makes the abutment of the panel against the mandrel more effective.

Preferably, said plate-like element is extended in extension of the head along a longitudinal direction of the arm.

Preferably, said mandrel is provided with a pair of said abutment surfaces parallel and opposed with respect to a median plane of the mandrel extended parallel to the trajectory, against which said blank is wound.

Preferably, said first retaining device is configured to retain said blank against each of said abutment surfaces.

Thereby, both opposed panels wound on the blank on the mandrel are held against the mandrel, ensuring a precise fold around the corresponding folding edge of both the rear panel and the blank flap intended to overlap and fix to each other by gluing.

Preferably said first retaining device comprises a pair of said arms operatively associated with the respective opposing abutment surfaces.

Preferably, a corresponding actuation device is associated with each corresponding arm.

Preferably, said arms are guided synchronously relative to the mandrel.

Thereby, the retaining action affects surface portions of the opposing panels wound on the mandrel which mirror each other with respect to the mandrel.

In an embodiment, the actuation device comprises a rack-and-pinion motion transmission mechanism, in which a rack integral with the arm of the first retaining device is coupled to a pinion driven in rotation by a motor member.

Preferably said arm is engaged telescopically, with sliding coupling, in a guide, to be displaced along said trajectory section between an extracted condition from the guide, reached in said second position, and a retracted condition in the guide, reached in said first position.

In an embodiment, the actuation device comprises an articulated quadrilateral kinematic system, whereby the arm of the first retaining device is displaced in an oriented manner along the section of movement trajectory.

Thanks to this feature, the movement of the arm is carried out exclusively with rotational movements between kinematically coupled parts of the system.

In a preferred embodiment, the folding device comprises an abutment element configured to retain the at least one panel of the blank against the abutment surface of the mandrel, in the advancement of said mandrel, at least up to a position along the first stroke, reached by the first retaining device, and in which the first retaining device reaches the mandrel, coming into contact with the at least one panel of the blank. Preferably, said position in which the first retaining device reaches the mandrel is comprised between said first and second position.

This thereby ensures that the panel is effectively held against the abutment surfaces of the mandrel even in the section of the stroke where it has not yet been reached by the retaining device.

Preferably said movement trajectory is contained in a horizontal plane.

Preferably said abutment surface of the mandrel is extended parallel to said horizontal plane.

In a preferred embodiment, the packaging method comprises the step of providing a second retaining device arranged downstream of the first retaining device, to retain the at least one panel of the blank against said abutment surface of the mandrel, during the advancement movement of the mandrel downstream of said section of movement trajectory.

In a preferred embodiment, the packaging method comprises the step of spacing the second retaining device from the folding device along said trajectory and moving the first retaining device between the folding device and the second retaining device.

In a preferred embodiment, the packaging method comprises the step of moving the first retaining device along said section of movement trajectory, in a first stroke, towards the folding device, with approach to the mandrel being advanced, and continuing said moving in a second return stroke, in the opposite direction.

In a preferred embodiment, the packaging method comprises the step of carrying the first retaining device, along at least part of the second stroke, accompanying the mandrel with the same speed as the mandrel.

In a preferred embodiment, the packaging method comprises the step of moving said first retaining device, along said first stroke, between a first position, in which the first retaining device is spaced from the advancing mandrel, and a second position in which the first retaining device is positioned in proximity to a first folding edge of the mandrel facing the folding device. It should be noted that some steps of the method described above can be independent of the order of execution reported. Furthermore, some steps can be optional. Furthermore, some steps of the method can be performed repetitively, or can be performed in series or in parallel with other steps of the method.

The features and advantages of the present solution will become clearer from the detailed description of an embodiment shown, by way of non-limiting example, with reference to the appended drawings in which.

Figure 1:
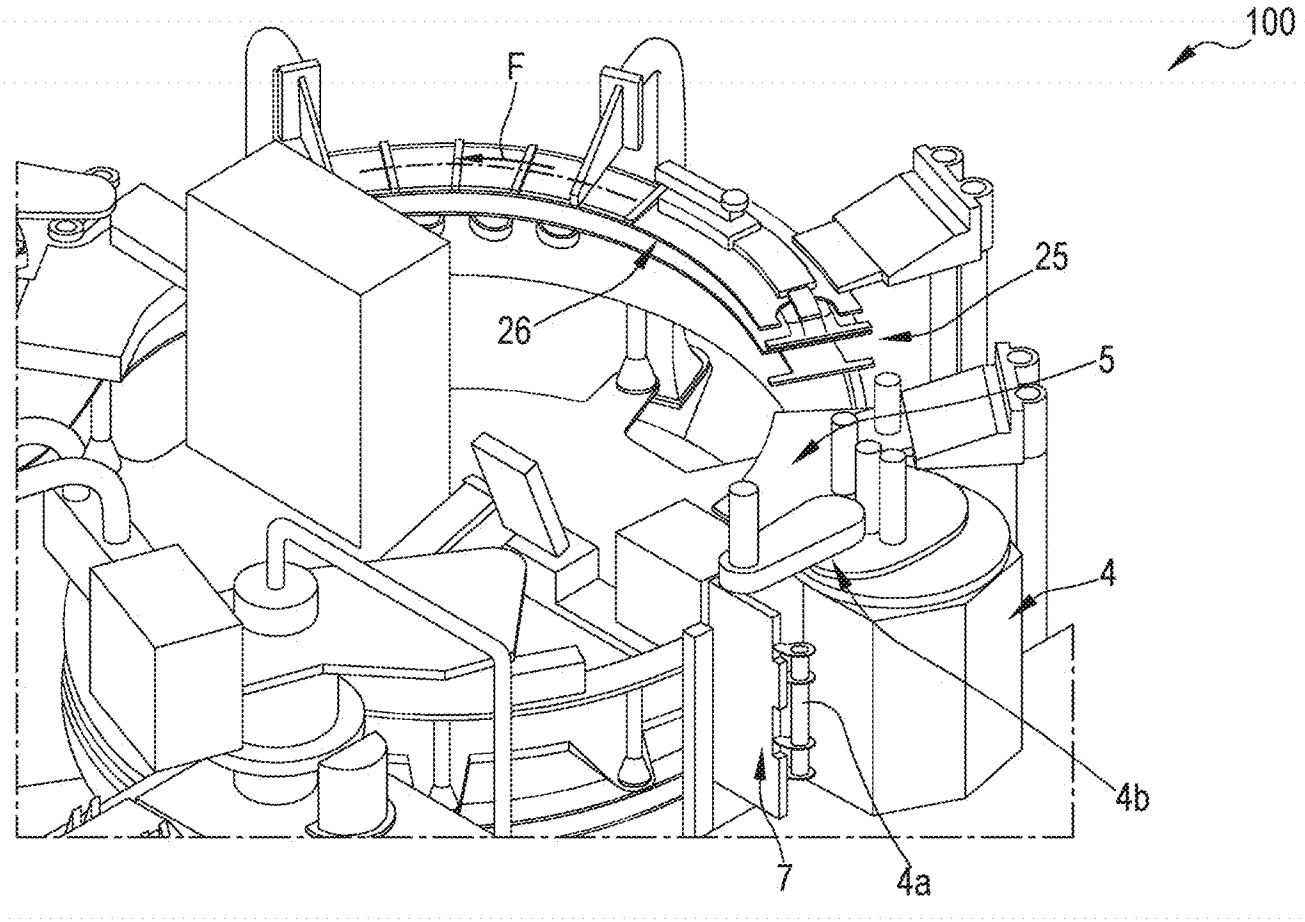
FIGS. 1 and 2 are partial schematic and plan perspective views of an example of a unit for packaging articles in boxes made in accordance with the present invention.
Figure 2:
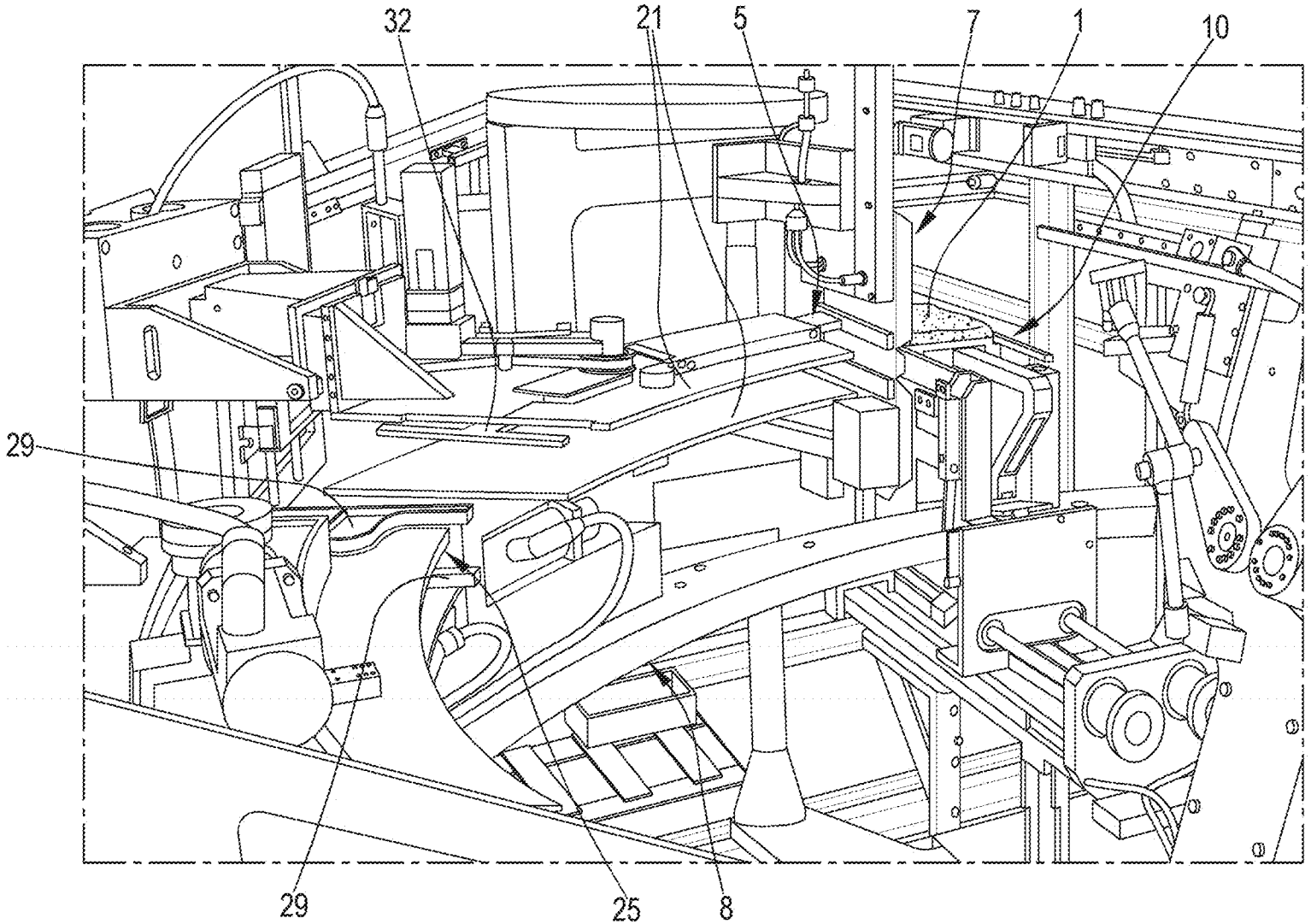
Figure 4:
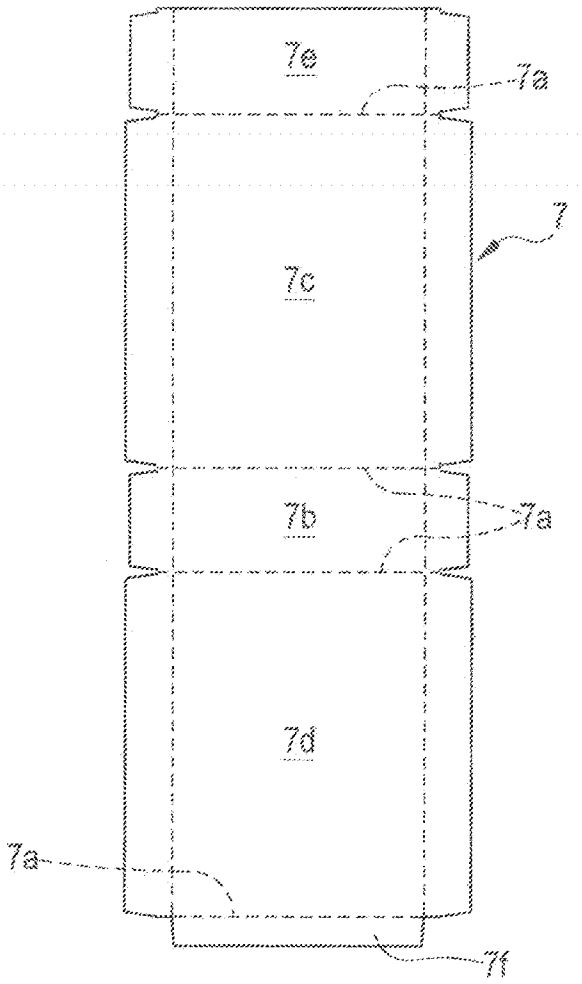
FIG. 4 is a schematic front elevation view of a blank intended to be wound on the mandrel shown in FIG. 3.
Figure 3:
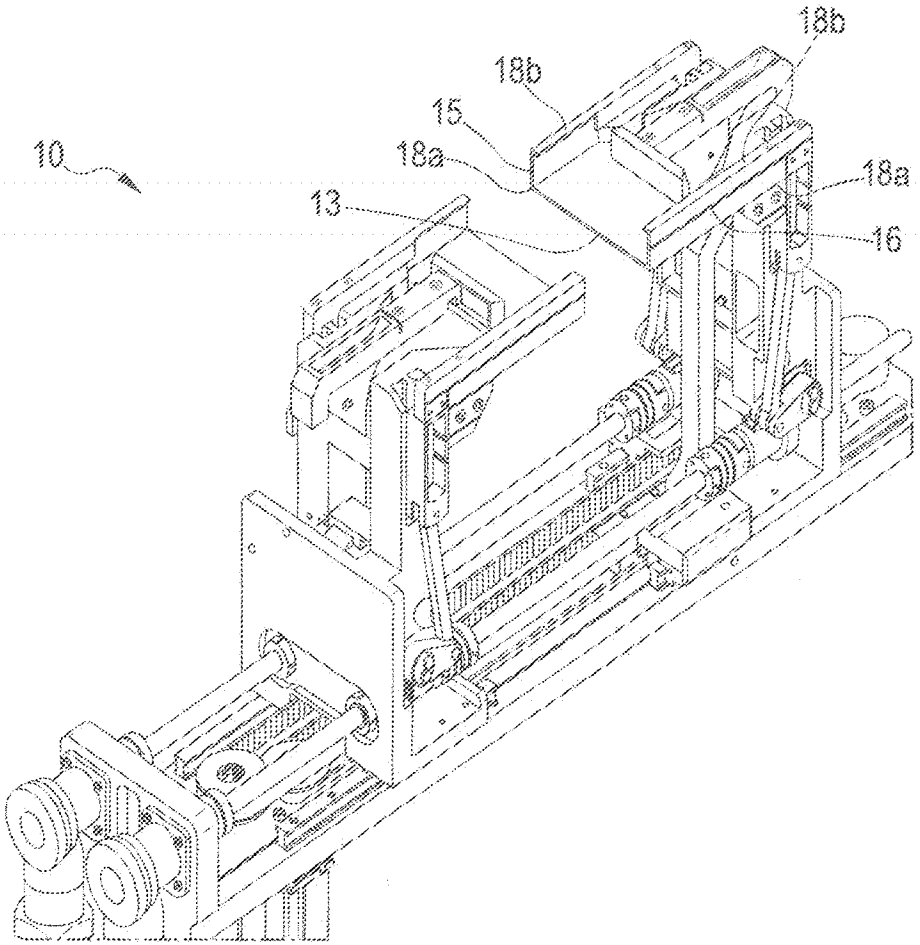
FIG. 3 is a partial schematic, perspective view of a mandrel of the packaging unit of FIGS. 1 and 2.

With initial reference to FIGS. 1 and 2, 100 overall indicates a packaging unit made in accordance with the present invention.

The packaging unit 100 is arranged to package one or more articles 1 inside boxes 2.

The articles 1 are, in this preferred example embodiment, bags containing granular, loose or bulk food products, e.g., cereal flakes.

The packaging unit 100 comprises, in its most general components, an article feeder, a blank feeding device 4 and a folding device 5 of the blanks.

The article feeder can be made in any form adapted to pick up an article 1 from an upstream work station (or from a warehouse) and deliver it to the devices of the packaging unit.

The blank feeding device 4, in turn, is configured to pick up a single blank 7 from a group of blanks stacked in a stacking zone and bring it in the packaging unit. For example, the feeding device 4 can comprise a plurality of gripping members 4*a* mounted on a carousel 4*b* rotatable around a substantially vertical axis.

The packaging unit 100 is arranged to receive each article 1 from the article feeder and form a respective box 2 around the same, starting from a blank 7 supplied by the blank feeding device 4. For this purpose, the packaging unit 100 comprises a mandrel 10 mounted on a carousel 8, rotatable around a vertical axis, so that the mandrel is moved along a circular trajectory in an advancement direction F. The trajectory is conveniently contained in a horizontal plane.

Thereby, the mandrel 10 is carried along the circular trajectory between a receiving zone, in which the mandrel 10 receives an article 1 from the article feeder, an abutment zone, in which the mandrel 10 abuts a blank 7 supplied by the blank feeding device 4, a forming zone, in which the blank 7 is folded, being wound around the mandrel 10, so as to form a box 2 containing the article 1, an unloading zone, in which the box 2 containing the article 1 is delivered to the next processing stations and, finally, a return zone in which the mandrel 10 is returned to the receiving zone.

In the embodiment described here, the mandrel 10 consists of a pair of separate and distinct units, both mounted on an arm radially extended from the carousel 8.

With reference to the vertical axis around which the carousel 8 rotates, the two units forming the mandrel 10, which are substantially identical to each other, are arranged facing each other in a radial direction, and along such a radial direction they are displaceable with respect to each other, between an operating position, in which the two units are approached to each other, and a non-operating position in which they are spaced apart from each other, so as to break up the mandrel 10. The radial direction also identifies a direction of longitudinal extension of the mandrel 10, and the advancement direction F of the mandrel 10, along the circular trajectory, is thus directed transversely, and in particular is perpendicular, to the aforementioned radial direction.

On the mandrel 10, in its configuration with the two units approached, a lower wall 13 is identified, defining the bottom surface on which the article 1 is deposited, as well as a pair of side walls 15 and 16, delimiting the lower wall 13 at the opposite longitudinal sides.

A lower edge 18*a* is also identified on each side wall 15, 16, which is substantially coplanar with the lower wall 13, and an upper edge 18*b*, spaced apart from and substantially parallel to the lower wall 13.

The pairs of lower edges 18*a* and upper edges 18*b* form the folding edges around which the blank 7 is folded for the formation of the box 2. In this embodiment example, the pairs of folding edges are configured to make the box 2 assume a parallelepiped shape with pairs of opposite side faces parallel to each other.

The pair of upper edges 18*b* defines an upper abutment surface for the blank 7, which is extended parallel to the lower wall 13.

Similarly, the side walls 15,16 and the bottom wall 13 define, on the corresponding outer sides of the mandrel 10, respective abutment surfaces of the blank folded in winding around the mandrel 10.

The blank 7 is made of cardboard and is suitably shaped to form a box 2 when folded around the mandrel 10.

For this purpose, folding lines 7*a* are obtained in the blank 7 which divide the blank 7 into a plurality of panels intended to form, alone or in combination, the different faces of the box 2.

The folding lines 7*a* are preferably creases, and each pair of adjacent panels can be oscillated around a respective folding line 7*a* separating them.

In particular, a central panel 7*b* is identified in the blank 7, which is intended to be abutted first by the mandrel 10 in the formation of box 2, as well as two panels 7*c*, 7*d* extended from the upper and from the lower sides of the central panel 7*b*, respectively, and separated therefrom by respective folding lines 7*a*. A further panel 7*e* is extended from the panel 7*c*, intended for the partial closure of the box in the tubular shape, which, when the box is formed, is parallel and opposite the central panel 7*b*. The panel 7*e* is also referred to as the 'rear panel', as it is opposite the central panel 7*b* frontally abutted first by the mandrel 10 in the advancement movement thereof.

For the formation of the opposite bases of the box 2, respective base panels are extended from opposite sides of each of the panels 7*b*, 7*c*, 7*d* and 7*e*, which can oscillate with respect to the respective side panel at the crease joining them.

The tubular shape assumed by the partially closed box is obtained by joining the rear panel 7*e* with a flap 7*f* protruding from panel 7*b*, which are brought into relative overlapping and then joined together, e.g., by gluing.

The folding device 5 is of the type comprising a pair of plates 21 positioned on the circular trajectory of the mandrel 10 immediately downstream of the point where the blank 7 is delivered to the packaging unit by the blank feeding device 4.

The plates 21 are parallel and opposite each other as well as mutually spaced so that mandrel 10 can be dragged therebetween at an approached distance between each of the two plates 21 and the lower and upper edges 18*a*, 18*b* of the side walls 15, 16 of the mandrel 10.

At the mouth defined between the plates 21, further folding members can be provided, intended to impact the blank, for folding the panels being wound on the mandrel, before the latter is carried between the plates 21.

Figure 7:
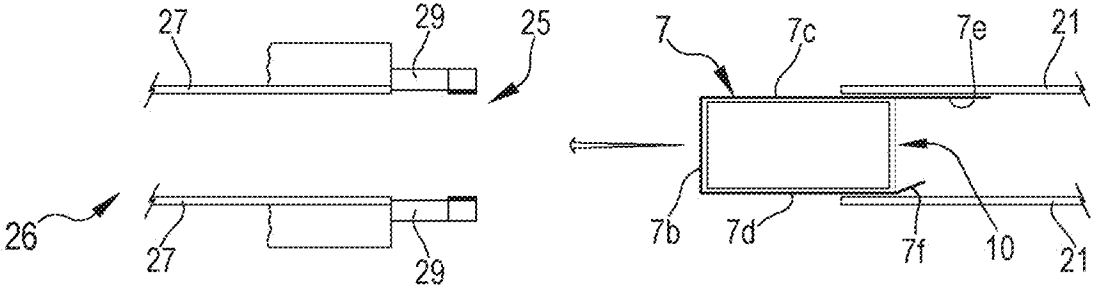
FIGS. 7 to 9 are schematic side views of the detail of FIG. 5, shown in cooperation with the mandrel, in respective and distinct operating positions.

Upon exiting the pair of plates 21, the blank 7 thus assumes a folded configuration, in partial winding on the mandrel 10, in which the central panel 7*b* is abutted against the side wall 15 of the mandrel 10, while the upper 7*c* and lower 7*d* panels are folded against the respective upper and lower abutment surfaces of the mandrel 10. Such a conformation is schematically shown in FIG. 7.

Downstream of the pair of plates 21, along the movement trajectory of the mandrel 10, it is provided that a closing member 22, mounted on the mandrel 10, cooperates with the mandrel 10 so as to fold the rear panel 7*e* against the side wall 16 of the mandrel 10, bringing said panel overlapping the flap 7*f*, for their gluing, for example by means of the prevision of glue points, so as to obtain the side closure of the box wound around the mandrel.

The closing member 22, for example configured in the form of a bar, is controlled in a movement with which it is lowered from above onto the trajectory of the mandrel 10 to perform the folding of the rear panel 7*e*, following the mandrel 10 in its advancement. This folding step is carried out in a section of the trajectory of the mandrel 10, extended downstream of the folding device 5, with respect to the advancement direction F of the mandrel 10.

The packaging unit 100 further comprises a first retaining device 25, movably guided along said trajectory section, and configured to cooperate with the mandrel 10 so as to retain the opposite upper and lower panels 7*c*, 7*d* of the blank against the respective abutment surfaces of the mandrel, in the advancement movement of the mandrel along the trajectory, and in particular during the folding step carried out by the closing member 22.

A second retaining device 26 is arranged downstream of the first retaining device 25, in a distanced position from the folding device 5 along the trajectory of the mandrel, and the first retaining device 25 is therefore movable between the folding device 5 and the second retaining device 26.

The second retaining device 26 comprises a pair of plates 27 parallel and opposite as well as mutually spaced apart so that the mandrel 10, in the advancement movement thereof, can be carried therebetween at an approached distance between each of the two plates 27 and the lower and upper edges 18*a*, 18*b* of the side walls 15, 16 of the mandrel 10.

Figure 5:
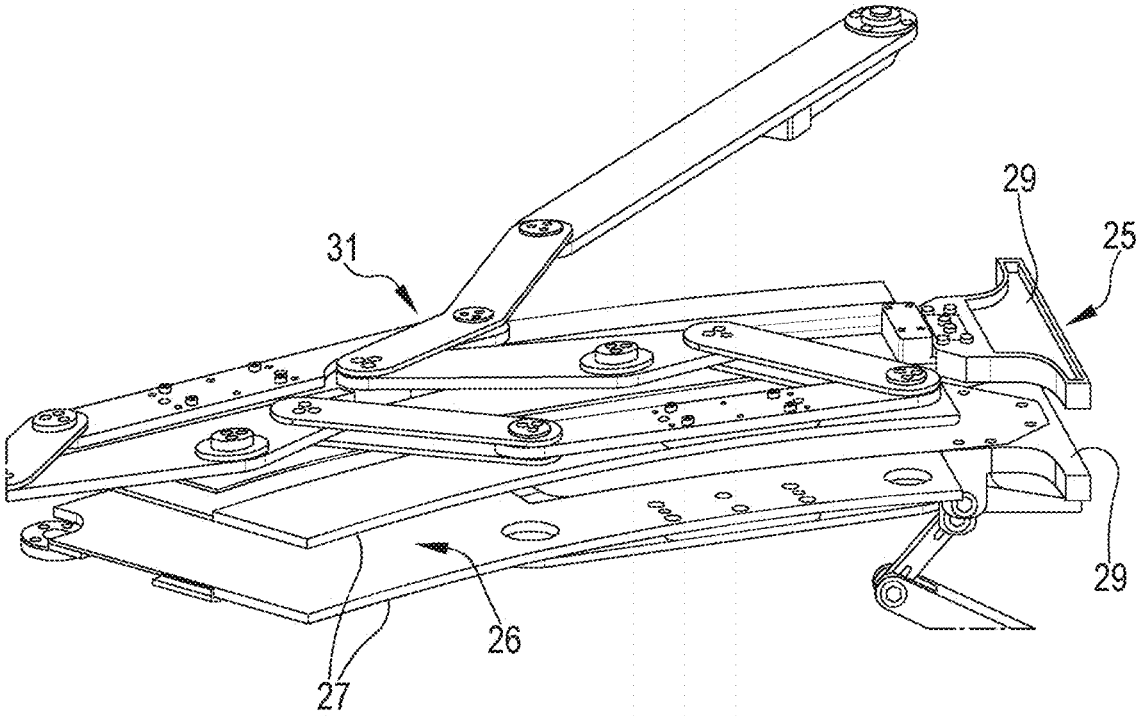
FIGS. 5 and 6 are partial schematic, perspective views of a detail of the packaging unit of the previous figures, depicted in two distinct operating positions.
Figure 6:
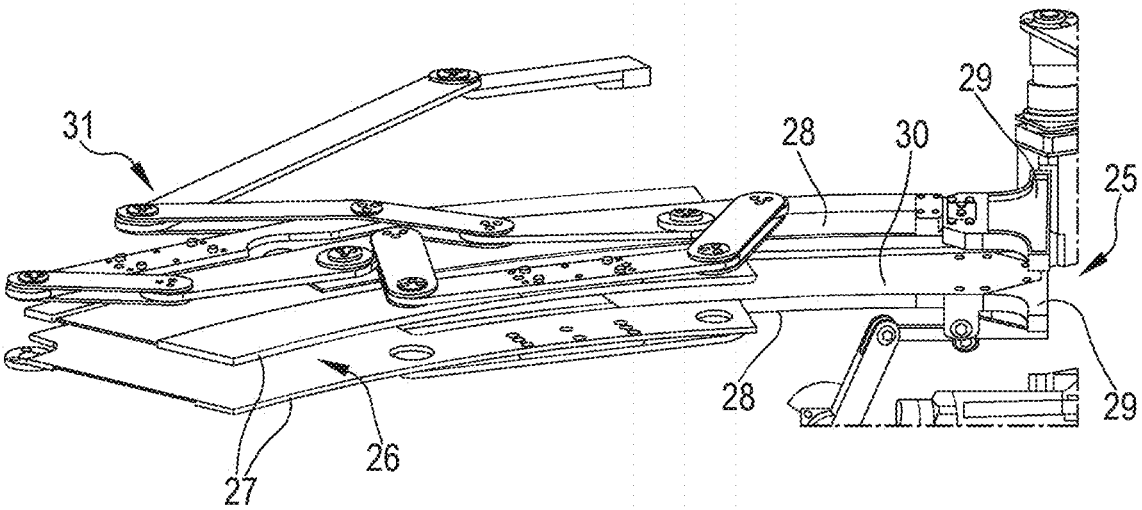

In more detail, the first retaining device 25 comprises a pair of opposite arms 28, parallel and spaced apart, each arm being mounted, in a movably guided manner, on the respective plate 27, so as to be displaced along the trajectory section between a first position (FIG. 5), in which it is approached to the corresponding plate 27 and a second position in which it is spaced apart in a remote position from the plate 27 (FIG. 6). The movements of the arms 28 occur in respective planes parallel to each other as well as parallel to the plane containing the movement trajectory of the mandrel 10. Conveniently, the movement trajectory of the mandrel is contained in a horizontal plane.

The arms 28 are driven in a synchronous movement, along a first stroke extended from the first to the second position, in approaching the mandrel 10, continued in a second return stroke, in the opposite direction, in which the arms 28 are driven accompanying the mandrel, in the same advancement direction and preferably with the same speed as the mandrel.

The distance between the arms 28 is chosen so that the mandrel 10, in the advancement movement thereof, can slide therebetween at an approached distance between each arm 28 and the folding edges of the mandrel 10 facing it.

Each arm 28 is fitted with an end head 29 capable of retaining, in the accompanying movement of the mandrel, the corresponding panel of the blank in contact against the corresponding abutment surface of the mandrel. In other words, the head 29 above the mandrel 10 retains the upper panel 7*c* of the blank against the corresponding upper abutment surface of the mandrel and the other head 29 below the mandrel retains the lower panel 7*d* of the blank against the corresponding lower abutment surface of the mandrel.

Figure 8:
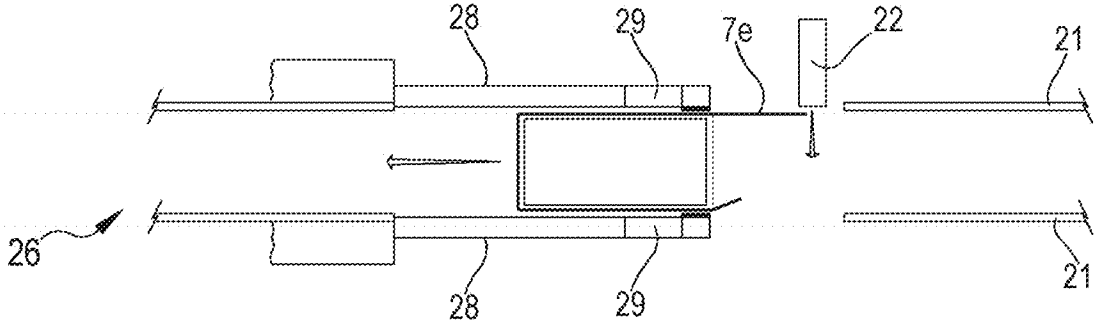
Figure 9:
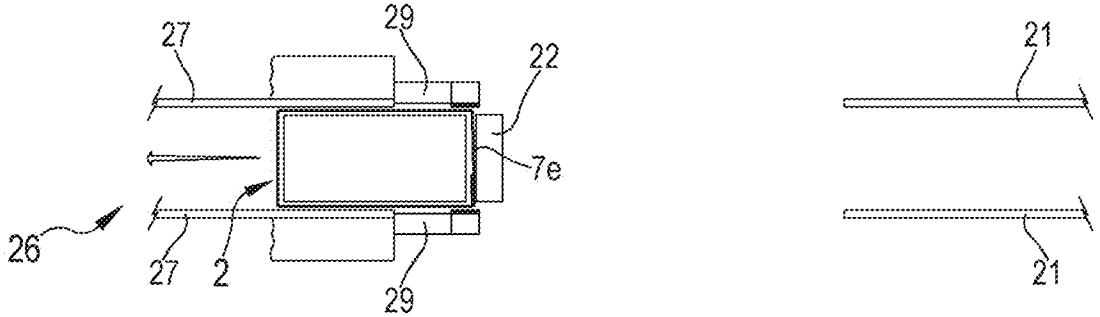

With reference to the sequence of operating positions of FIGS. 7 to 9, in FIG. 7 the arms 28 are shown in the first position, close to the respective plates 27.

In FIG. 8 the arms 28 are shown in the second position, having reached the end of the first stroke. The movements of the arms and mandrel along the trajectory section are configured in so that in the second position both heads 29 are positioned in proximity of the respective folding edges 18*a*, 18*b* of the mandrel facing towards the folding device 5.

In FIG. 9, the arms are shown again in the first position, reached at the end of the second stroke, after the accompanying movement of the mandrel has finished. The latter, continuing along its trajectory, is carried between the plates 27, to be delivered to an unloading station where the box, having completed the side closure, is extracted from the mandrel 10, and the mandrel is returned to the loading zone.

Figure 10:
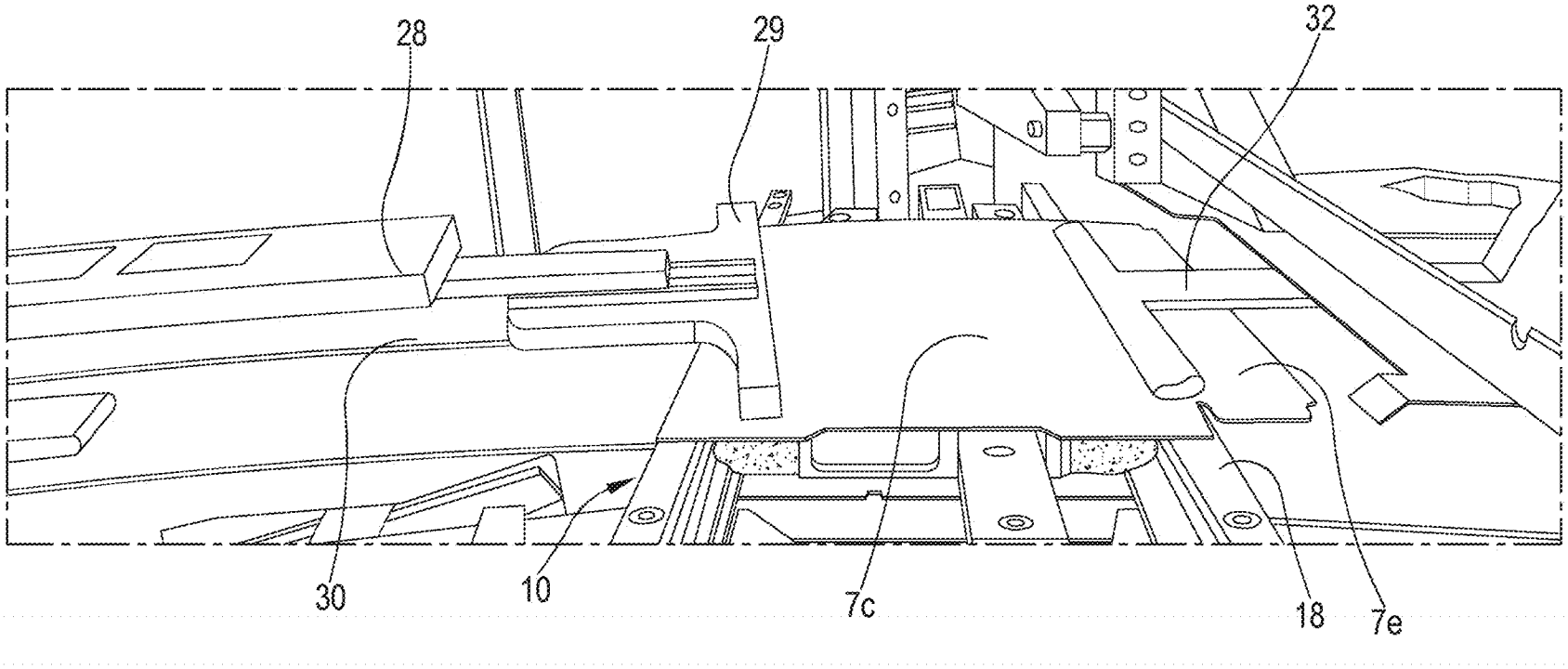
FIG. 10 is a schematic perspective view of the detail of FIG. 5, shown in cooperation with the mandrel, in a further operating position.

FIG. 10 shows a further position reached within the first stroke, in which the arms 28 reach the advancing mandrel 10, coming into contact with the corresponding panels of the blank 7.

Each head 29 has a substantially 'T' shape, in which the enlarged portion extends along a prevalent part of the longitudinal dimension of the panels in the contact zone with the blank 7, developed along the folding edges.

The number 30 denotes a respective plate-like element, extended in extension of each head 29 along the longitudinal extension of the corresponding arm 28. The plate-like element 30 is configured to cooperate with the head 29 in retaining the corresponding panel of the blank against the corresponding abutment surface of the mandrel.

Each arm 28 is carried in its movement along the trajectory section by means of a respective actuation device comprising an articulated quadrilateral kinematic system, indicated with 31, by means of which the corresponding arm 28 is carried in an oriented manner along the trajectory section. The kinematic system 31 allows to convert a rotational motion entering the system into an alternating movement of the arm 28 to travel, along the trajectory section, the first stroke in one direction and the second stroke in the opposite direction.

In an embodiment variant, not illustrated in the figures, the actuation device can comprise a mechanism for transmitting the motion of each arm 28 of the rack-and-pinion type, in which a rack made integral with arm 28 is coupled to a pinion driven in rotation by a motor member.

The number 32 denotes an abutment element integral with the plates 21 of the folding device, which is arranged at an exit section from the plates 21. Said abutment element 32 is configured to retain the upper panel 7*c* against the corresponding abutment surface of the mandrel 10, during the advancement of the mandrel exiting from the plates 21, so as to exert a retaining action at least up to a position (shown in FIG. 10) along the first stroke, in which the arms 28 reach the mandrel coming into contact with the panels of the blank 7. This thereby ensures that the upper panel 7*c* of the blank is always held abutted against the mandrel 10, even during the time it takes the arms 28 to travel the part of the first stroke required to reach the mandrel 10.

It is observed that the retaining action of the panels of the blank 7 in abutment against the mandrel 10 exerted by the arms 28, during the folding step of the rear panel performed by the closing member 22, ensures that the folding of the rear panels occurs accurately along the folding edges of the mandrel 10, ensuring the correct overlapping of the flaps provided for gluing, and also allows that such folding operations and subsequent closure of the box are performed by accompanying the mandrel 10 along its trajectory after it has been abutted upon exiting the folding device 5, so as to free the suitable space to allow the operating movement of the closing member 22 relative to the mandrel 10.

The invention claimed is:

1. A packaging unit for packaging articles in boxes, comprising:

a mandrel configured to accommodate at least one of said articles therein, a movement device configured to move said mandrel along a movement trajectory, a feeding device configured to feed at least one blank towards said mandrel, a folding device configured to cooperate with said mandrel to fold at least one panel of said blank being wound around said mandrel, to form one of said boxes, a first retaining device movably guided parallel to said movement trajectory and configured to cooperate with the mandrel along a section of said movement trajectory, the first retaining device retaining said at least one panel of the blank wound on said mandrel against an abutment surface of the mandrel, the abutment surface of the mandrel extended parallel to the movement trajectory, and a second retaining device, arranged downstream of the first retaining device, and configured to retain said at least one panel of the blank against said abutment surface of the mandrel in an advancement movement of the mandrel downstream of said section of said movement trajectory, wherein the second retaining device is spaced apart from the folding device along said movement trajectory and the first retaining device is movable between the folding device and the second retaining device in a direction of said movement trajectory.

2. The packaging unit according to claim 1, wherein the first retaining device is mounted on the second retaining device.

3. The packaging unit according to claim 1, wherein said second retaining device comprises a pair of spaced apart plates, parallel, and constrained to a fixed structure of said packaging unit.

4. The packaging unit according to claim 1, further comprising an actuation device configured to displace said first retaining device along a first stroke of said section of said movement trajectory towards the folding device with approach to the mandrel, and along a second stroke in an opposite direction.

5. The packaging unit according to claim 4, wherein, along at least part of the second stroke, the first retaining device is carried to accompany the mandrel with a same advancement speed as the mandrel.

6. The packaging unit according to claim 4, wherein the first stroke extends along at least part of the section of the movement trajectory between the folding device and the second retaining device.

7. The packaging unit according to claim 4, wherein:

the actuation device is further configured to displace the first retaining device along the first stroke between a first position and a second position, in the first position the first retaining device is spaced apart from the advancing mandrel, and in the second position the first retaining device is positioned in proximity to a first folding edge of the mandrel facing the folding device.

8. The packaging unit according to claim 7, wherein:

in said first position, said first retaining device approaches the second retaining device, and in said second position, said first retaining device is displaced to a remote position from said second retaining device.

9. The packaging unit according to claim 4, wherein said first retaining device comprises an arm operatively associated with the actuation device, said arm bearing at one end thereof a head capable of retaining the at least one panel of the blank against the abutment surface of the mandrel.

10. The packaging unit according to claim 9, wherein said head is configured to extend, in contact with the blank, along the at least one panel of the blank and a first folding edge of the mandrel.

11. The packaging unit according to claim 1, said mandrel comprising a pair of abutment surfaces parallel and opposed to each other with respect to a median plane of the mandrel extended parallel to the trajectory, wherein:

said blank is wound against each of said abutment surfaces, and said first retaining device is configured to retain said blank against each of said abutment surfaces.

12. The packaging unit according to claim 4, wherein the folding device comprises an abutment element, wherein:

the abutment element is configured to retain the at least one panel of the blank against the abutment surface of the mandrel in an advancement of said mandrel at least up to a third position along the first stroke, the third position located between said first position and second position, and the first retaining device reaches the mandrel and contacts the at least one panel of the blank.

13. A method for packaging articles in boxes comprising:

(a) providing a mandrel and accommodating at least one of said articles in said mandrel, (b) moving said mandrel along a movement trajectory, (c) feeding at least one blank towards the mandrel, (d) providing a folding device configured to cooperate with said mandrel to fold at least one panel of said blank around the mandrel for the formation of one of said boxes, (e) moving a first retaining device to cooperate with the mandrel along a section of the movement trajectory, (f) retaining said at least one panel of the blank, wound on the mandrel, against an abutment surface of the mandrel extended parallel to the movement trajectory, by said first retaining device, (g) providing a second retaining device arranged downstream of the first retaining device, to retain the at least one panel of the blank against said abutment surface of the mandrel, during an advancement movement of the mandrel downstream of said section of said movement trajectory, and (h) spacing the second retaining device from the folding device along said section of said movement trajectory and moving the first retaining device between the folding device and the second retaining device in a direction of said movement trajectory.

14. The packaging method according to claim 13, further comprising:

(e1) moving the first retaining device along said section of movement trajectory, in a first stroke, towards the folding device, with approach to the mandrel being advanced, and continuing said moving in a second return stroke, in the opposite direction.

15. The packaging method according to claim 14, further comprising:

(e2) carrying the first retaining device, along at least part of the second stroke, accompanying the mandrel with the same speed as the mandrel.

16. The packaging method according to claim 14, further comprising:

(e3) moving said first retaining device, along said first stroke, between a first position, in which the first retaining device is spaced apart from the advancing mandrel, and a second position, in which the first retaining device is positioned in proximity to a first folding edge of the mandrel facing the folding device.

* * * * *